United States Patent [19]

Johanson

[11] Patent Number: 4,715,085

[45] Date of Patent: Dec. 29, 1987

[54] VACUUM CLEANER AND METHOD OF DISSIPATING ELECTROSTATIC CHARGE

[75] Inventor: Robert H. Johanson, Danville, Ky.

[73] Assignee: Whirlpool Corporation, Benton Harbor, Mich.

[21] Appl. No.: 944,418

[22] Filed: Dec. 19, 1986

[51] Int. Cl.[4] ..... A47L 9/28

[52] U.S. Cl. ..... 15/339; 15/377; 174/47; 361/212; 361/220

[58] Field of Search ..... 15/339, 377; 174/47; 361/212, 215, 220, 221, 222

[56] References Cited

U.S. PATENT DOCUMENTS

| | | | |
|---|---|---|---|
| 1,920,889 | 8/1933 | Pullen | 361/220 X |
| 3,780,345 | 12/1973 | Earman | 361/220 |
| 4,194,081 | 3/1980 | Medford | 174/47 |
| 4,215,384 | 7/1980 | Elson | 174/47 X |
| 4,345,297 | 8/1982 | Check | 361/222 X |

*Primary Examiner*—Chris K. Moore

*Attorney, Agent, or Firm*—Mason, Kolehmainen, Rathburn & Wyss

[57] ABSTRACT

A vacuum cleaner includes a motor and an elongate conductive tubular member and a system for dissipating an electrostatic charge accumulated on the tubular member. In a canister vacuum cleaner, a rigid wand, mechanically and pneumatically interconnected between a wand handle and a floor cleaning unit, is electrically conductively connected to a motor in the floor cleaning unit to dissipate or drain off any electrostatic charge accumulated on the rigid wand. Furthermore, one or more corona discharge elements are disposed in the wand handle and are electrically conductively connected to the rigid wand to effect a corona discharge into the air flowing through the vacuum cleaner, thereby to dissipate the electrostatic charge accumulated on the rigid wand. In an upright vacuum cleaner, an elongate conductive tubular handle is electrically conductively connected to the motor of the upright vacuum cleaner, thereby to dissipate or drain off an electrostatic charge accumulated on the handle. In either the canister vacuum cleaner or the upright vacuum cleaner, a current limiting resistor is electrically connected in series between the motor and the elongate conductive tubular member to prevent an unpleasant shock or harm to an operator of the vacuum cleaner.

24 Claims, 10 Drawing Figures

10
12
14
16
18
20
22
24
26
28
30
32
33
34
36
38
40
42
43
44
46
48
50
52
54
56
58
60
61
62
64
66
68
70
72
74
76
78
80
82
84
10°
3
4

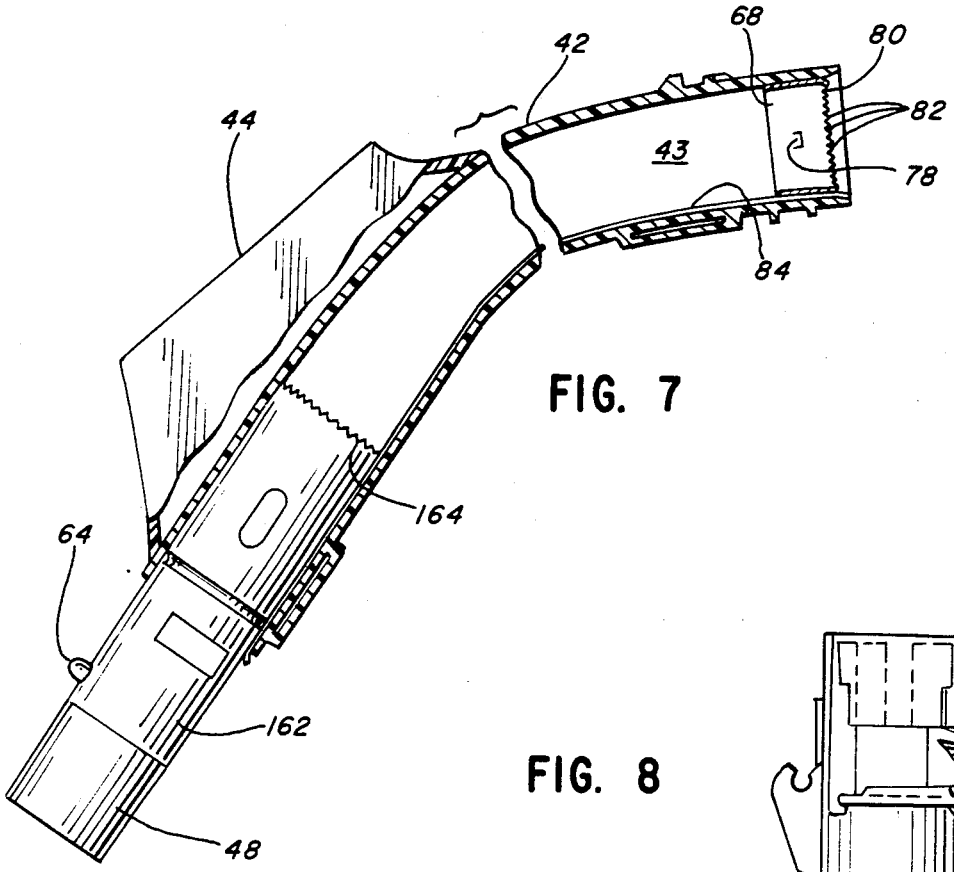
FIG. 7
FIG. 8
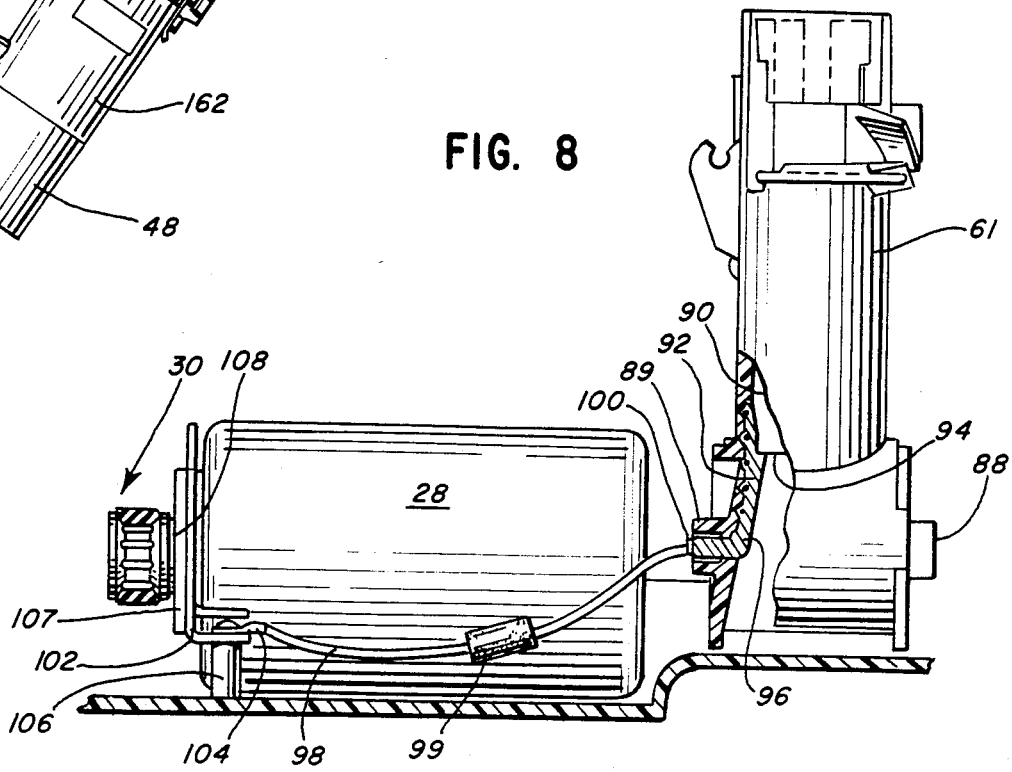
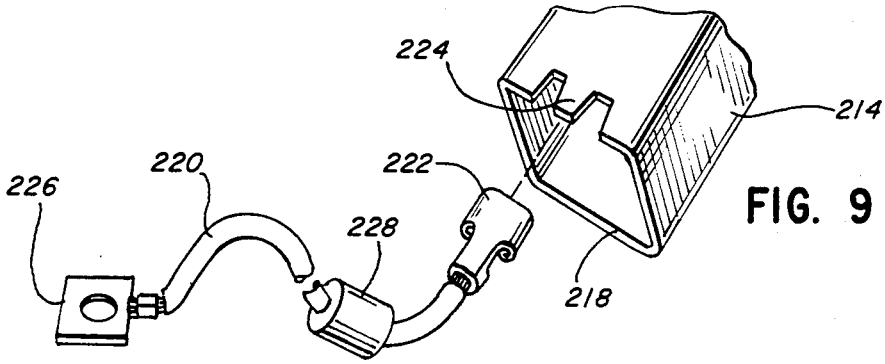
FIG. 9

VACUUM CLEANER AND METHOD OF DISSIPATING ELECTROSTATIC CHARGE

BACKGROUND OF THE INVENTION

A. Field of the Invention

The present invention generally relates to vacuum cleaners and, more particularly, to a vacuum cleaner constructed to prevent the accumulation of a high level electrostatic charge on its components.

B. Description of the Prior Art

As a general principle, any two dissimilar bodies coming into frictional contact will generate an electrostatic charge. An electrostatic charge may accumulate on components of a vacuum cleaner due to this principle and to the flow of particulate matter passing through the vacuum cleaner. In extreme situations, the accumulated electrostatic charge may reach an electrical potential sufficiently high to cause an electrostatic discharge, risking an unpleasant or harmful shock to the user of the vacuum cleaner or damage to the electrical controls of the vacuum cleaner. Furthermore, the accumulated charge may result in a build up of particulate matter on the inner surfaces of the vacuum cleaner components that, in some cases, may interfere with material movement through the vacuum cleaner.

Several efforts have been made in the past to eliminate or control the accumulation of electrostatic charge. One suggested effort involved the use of antistatic material in the fabrication of the components of an implement as discussed in U.S. Pat. No. 2,108,759. The use of antistatic materials has the disadvantage of significantly increasing the cost of the implement. Another prior art approach disclosed in U.S. Pat. No. 390,196 involved electrically connecting all the conductive components of an implement and directing a spark discharge to an area of little danger to the implement or the implement user. A significant problem with using that approach on a household implement such as a vacuum cleaner is that the possibility of shock to the user is not necessarily eliminated.

Another proposed solution disclosed in U.S. Pat. No. 1,920,889 is to dissipate the electrostatic charge through the body of the user of an implement. This proposal also has the significant disadvantage of user shock and would be unacceptable for use in vacuum cleaners.

It is desirable in the vacuum cleaner art to maintain the level of the electrical potential due to electrostatic charge accumulation to a level below the threshold for shock sensation detectable by a user, i.e., below the range of approximately 5,000 to 10,000 volts.

SUMMARY OF THE INVENTION

An object of the present invention is to provide a new and improved vacuum cleaner.

Another object of the present invention is to provide a vacuum cleaner constructed to prevent the accumulation of an electrostatic charge during its use.

A further object of the present invention is to provide a new and improved method or process of dissipating an electrostatic charge in a vacuum cleaner during use.

A still further object of the present invention is to provide a vacuum cleaner with a new and improved electrostatic charge dissipating system that provides a conductive path between charge carrying components of the vacuum cleaner and an internal motor.

Another object of the present invention is to provide a vacuum cleaner having a new and improved system for dissipating an electrostatic charge from components of the vacuum cleaner that allows the vacuum cleaner to be used with a surface cleaning unit or with other attachments.

Briefly, the present invention constitutes a new and improved vacuum cleaner system for dissipating an electrostatic charge from components of the vacuum cleaner, thereby reducing the risk of shock to the user and damage to the electrical control system of the vacuum cleaner. The vacuum cleaner includes a rotatable brush powered by a brush motor. The brush and motor may be located in a floor cleaning unit remotely disposed from a debris receptacle, normally a porous paper bag, provided for the collection of particulate matter. The floor cleaning unit may be interconnected to the receptacle through a wand and a wand handle and hose assembly in one embodiment or a structure including a handle in a second embodiment.

During the operation of the vacuum cleaner, particulate matter passing through the wand to the receptacle results in electrostatic charging on the wand and wand handle. To dissipate a resultant electrostatic charge from the wand and the wand handle, a conductive path is provided between these components and a conductive bushing mount for the rotating armature of the brush motor is provided. An electrical conductor is mounted, for example, in the floor cleaning unit in a position to engage the wand when the wand is coupled to the floor cleaning unit. An electrically conductive wire is also provided for electrically interconnecting the conductor and the brush motor mount. The rotating armature of the brush motor effects the dissipation of an electrostatic charge from the wand and the wand handle. As a safety feature, a 2.7 million ohm resistor may be connected between the motor and the wand to prevent harmful shock to the user in the unlikely event of failure of the insulation of the brush motor. Additionally, it has been found that the resistor limits the rate of static dissipation so as to minimize generation of electromagnetic interference which can adversely affect electronic control devices.

In order to vacuum different surfaces, such as curtains, the floor cleaning unit may be disconnected from the wand and a different attachment connected to the wand. To dissipate an electrostatic charge from the wand and the wand handle when cleaning with an attachment of this type (or even with the floor cleaning unit), one or more corona discharge elements are mounted in the wand handle. An electrically conductive lead or strap secured in the wand handle by a heat staking process electrically interconnects the wand and any remotely disposed corona discharge element. Each corona discharge element includes a roughened or serrated downstream end to which an electrostatic charge, that is, static electrons, migrates for discharge into the air flowing through the wand handle during the operation of the vacuum cleaner.

In a second embodiment of the present invention, an upright vacuum cleaner includes a debris receptacle for particulate matter, a housing for the receptacle and a handle that extends into and is secured to the housing. Due to the proximity of the handle to the receptacle, an electrostatic charge accumulated in the receptacle may transfer to the handle. The charge may then be dissipated by electrically interconnecting the motor of the vacuum cleaner to the handle through an electrical conductor and a serially connected 2.7 million ohm safety resistor.

The improved vacuum cleaner provides for the dissipation of an electrostatic charge through the full range of use of the vacuum cleaner. This protection is provided by a minimum number of additional parts and at a small incremental cost.

BRIEF DESCRIPTION OF THE DRAWING

The above and other objects, advantages and novel features of the present invention will become apparent from the following detailed description of the preferred embodiment of the present invention illustrated in the accompanying drawing wherein:

FIG. 7 is an enlarged, cross-sectional view similar to FIG. 2 of an alternative wand handle with a serrated stub tube;

FIG. 8 is an enlarged, fragmentary view depicting a connection of the surface cleaning unit of the vacuum cleaner of the present invention;

FIG. 9 is an enlarged, perspective view of a ground wire connection to the handle of an upright vacuum cleaner.

DESCRIPTION OF THE PREFERRED EMBODIMENT

Figures 1, 2, 3, 4, 5, 6:
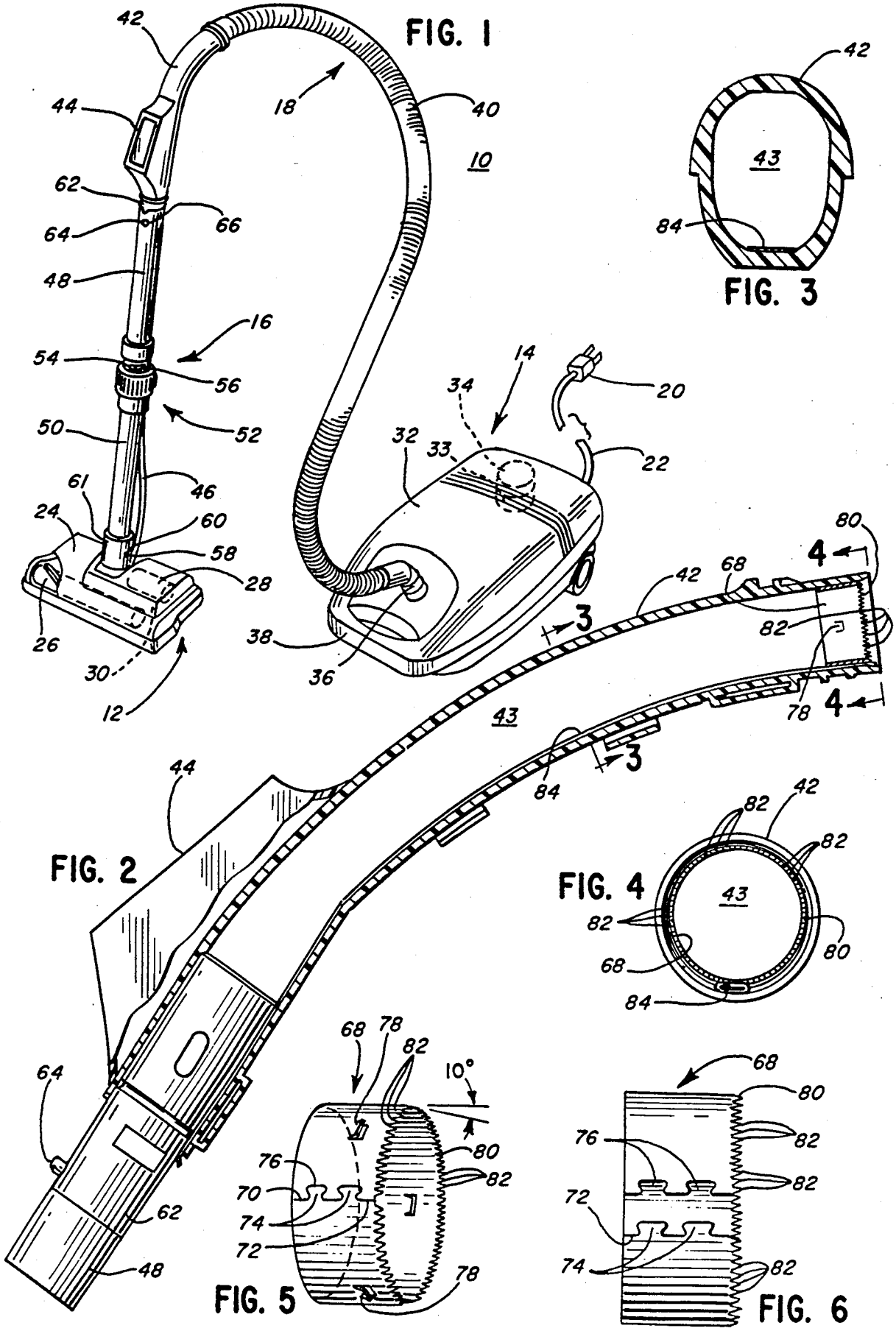
FIG. 1 depicts a vacuum cleaner, including components for dissipating an electrostatic charge, constructed in accordance with the principles of the present invention.
FIG. 2 is an enlarged, cross-sectional view of a wand handle of the device of FIG. 1.
FIG. 3 is an enlarged, cross-sectional view generally taken along line 3—3 in FIG. 2.
FIG. 4 is an enlarged, end elevational view generally taken from line 4—4 in FIG. 2.
FIG. 5 is an enlarged, perspective view of a corona discharge element adapted to be mounted in the wand handle of FIG. 2.
FIG. 6 is an enlarged, elevational view similar to the view of FIG. 5 in which the corona discharge element is in an open, pre-installed condition.

Referring to the drawing and initially to FIG. 1, there is illustrated a new and improved canister vacuum cleaner 10 having a new and improved system for dissipating an electrostatic charge constructed in accordance with the principles of the present invention. The vacuum cleaner 10 includes a surface or floor cleaning unit 12 and a remotely disposed canister 14 mechanically and pneumatically interconnected by a wand 16 and a wand handle and hose assembly 18. The vacuum cleaner 10 is powered by conventional, 110–120 volt alternating current power through an electrical plug 20 mechanically and electrically secured to a conventional, retractable, electrical power cord 22.

The floor cleaning unit 12 includes a housing 24 in which are disposed a rotatable brush 26 and an electrical brush motor 28 for rotating the brush 26 through a conventional belt drive assembly 30. The canister 14 includes a housing 32 within which are disposed a conventional dirt collecting bag (not illustrated) and a suction or vacuum fan 33 and a conventional, electrical motor 34 for rotating the fan 33. The canister 14 also includes a suction inlet 36 connected to the wand handle and hose assembly 18 and an integrally formed, canister handle 38 for enabling the canister 14 to be carried by an operator of the vacuum cleaner 10.

Suction created by the fan 33, when driven by the motor 34, is delivered to the remotely located floor cleaning unit 12 through the wand handle and hose assembly 18 and the wand 16. The wand handle and hose assembly 18 includes a conventional flexible hose 40 and a rigid wand handle 42. The wand handle 42 is preferably plastic, generally tubular in shape and includes an elongated, interiorly disposed tubular bore 43 (FIG. 2) for pneumatically interconnecting the fan 33 in the canister 14 with the floor cleaning unit 12 through the wand 16 and the hose 40. The operation of the vacuum cleaner 10 is controlled by suitable power controls (not shown) disposed in a housing 44 that may be an integrally molded part of the wand handle 42. The wand 16 includes an externally disposed power cord 46 that electrically interconnects the electronic controls in housing 44 with the motor 28 in the floor cleaning unit 12.

In order to allow the canister vacuum cleaner 10 to vacuum different surfaces and objects or to be stored or to use different attachments, the wand 16 may be disconnected at any one of three locations. An attachment other than the floor cleaning unit 12 may be connected at any of these locations or the wand 16 may be used without attachments. The wand 16 includes an upper wand section 48 and a lower wand section 50 that may be disconnected from each other or from the floor cleaning unit 12 or from the wand handle 42. The upper wand section 48 is coupled to the lower wand section 50 by a coupling 52. The coupling 52 allows for the quick disconnection of the upper wand section 48 from the lower wand section 50 through the use of a conventional spring biased pin 54 and slot 56 combination. To disconnect the upper wand section 48 from the lower wand section 50, the user of the vacuum cleaner 10 simply depresses the pin 54 and pulls the upper wand section 48 out of the coupling 52. The upper wand section 48 may then be used for cleaning or an attachment may be connected to the upper wand section 48 for vacuuming items such as curtains and furniture.

In a similar manner, the lower wand section 50 may be disconnected from the floor cleaning unit 12 through the actuation and movement of a spring biased pin 58 on the lower wand section 50 out of an aperture 60 in a swivel connector 61. Another attachment may then be secured to the lower wand section 50 for cleaning or the lower wand section 50 can be used without an attachment.

The upper wand section 48 is connected to a stub tube 62 securely fixed in the upstream end of the tubular bore 43 of the wand handle 42 (FIG. 2). A quick disconnect connection between the upper wand section 48 and the stub tube 62 is provided by a spring biased pin 64 in the upper wand section 48 and an aperture 66 in the stub tube 62.

During the use of the vacuum cleaner 10, an electrostatic charge can accumulate on the wand 16 due to the flow of particulate matter through the wand 16. In extreme situations, a sufficiently high charge could accumulate in conventional prior art vacuum cleaners resulting in a high static voltage discharge, risking a shock to the user and damage to the vacuum cleaner controls in the housing 44, particularly if those controls include a microprocessor. In accordance with the principles of the present invention, an electrical leakage path is provided for the accumulating charge such that the leakage rate becomes equal to the charging rate. As charged surfaces increase in electrical potential, their natural leakage rate also increases. This increase in natural leakage rate is employed in the present invention to bleed or discharge the accumulated charge, in one embodiment, through a corona discharge into free space.

To accomplish a corona discharge of an electrostatic charge present in the vacuum cleaner 10, a corona discharge element 68 is mounted in the downstream end of the tubular bore 43 of the wand handle 42 (FIG. 2). In the preferred embodiment, the corona discharge element 68 is a split ring fabricated of stainless steel (FIG. 6). The corona discharge element 68 includes interlocking ends 70 and 72 formed to provide a tongue and groove connection, i.e., a plurality of tongues 74 on the end 72 interconnect with a plurality of mating grooves 76 on the end 70. By placing the tongues 74 in the grooves 76, the corona discharge element 68 is locked in a closed configuration (FIG. 5) and then may be inserted into the downstream end of the tubular bore 43 of the wand handle 42. The corona discharge element 68 is held within the downstream end of tubular bore 43 by several outwardly projecting tabs 78 disposed about the periphery of the corona discharge element 68 that frictionally engage the inner peripheral surface of the tubular bore 43 to hold the corona discharge element 68 firmly in position.

Since an electrostatic charge tends to migrate to a sharp edge or point at which a corona discharge may occur, the downstream edge 80 of the corona element 68 may be roughened to define a plurality of sharp edges or points. Specifically, the edge 80 may be serrated. To maximize the dissipation of the charge through a corona discharge into the flowing air, it is desirable both to provide a large number of serrations 82 and to form the serrations 82 such that they extend in a downstream direction and radially inwardly, slightly into the air flow. Each tip of each serration 82 is inclined radially inwardly approximately 10° (FIG. 5). Further inclination of the tips into the airstream could interrupt the flow; and particulate matter may be caught on the tips tending to block flow through the tubular bore 43.

By locating the corona discharge element 68 in the downstream end of the tubular bore 43, the corona discharge element 68 is spaced from the wand 16 and the stub tube 62. To enable the migration of the electrostatic charge to the corona discharge element 68, an electrically conductive lead or strap 84, preferably made of brass and in physical and electrically conductive contact with both the corona discharge element 68 and the stub tube 62, is secured by a heat staking process on the inner peripheral surface of the wand handle 42 along the tubular bore 43.

The conductive strap 84 may be secured to the inside peripheral surface of the tubular bore 43 by a heat staking process. For example, the wand handle 42 may be mounted on a secure surface; and the strap 84 may be positioned along the bottom surface of the tubular bore 43. Positive and negative electrodes may then be applied to the opposite ends of the strap 84; and a total of approximately four pounds of continuous tensile force should be applied through the electrodes to the strap 84 to hold the strap 84 against the bottom surface of the bore 43. The strap 84 may then be heated, for example, by supplying twenty amperes of electrical D.C. current through the electrodes and the strap 84 for approximately twenty-five seconds. Once the heating is terminated, the strap 84 should be allowed to cool for approximately fifteen seconds before the electrodes are removed. The strap 84 may, thus, be securely bonded to the plastic wand handle 42 by the above heat staking process and should, after heating and bonding, be positioned flush with the original inner peripheral surface of the bore 43 to avoid presenting an obstruction to air flowing through bore 43 and to avoid presenting a surface or edge for catching dirt and other particulate matter flowing through the bore 43.

The strap 84 extends out of the bore 43 at a location to be engaged by the corona discharge element 68 upon its insertion in the downstream end of the bore 43. The strap 84 enables the electrostatic charge on the wand 16 and the stub tube 62 to migrate to the corona discharge element 68 and from there to be dissipated into the air flowing through the wand handle 42.

Positioning the corona discharge element 68 in the downstream end of the tubular bore 43 has the advantage of allowing the wand 16 to be disconnected from the floor cleaning unit 12 and to be connected to other attachments to clean articles such as curtains and other surfaces. The corona discharge element 68 may be supplemented by the use of an alternative stub tube 162 (FIG. 7) with the vacuum cleaner 10. The alternative stub tube 162 is substantially identical to the stub tube 62 except that a downstream end 164 of the alternative stub tube 162 is roughened to provide a corona discharge surface. Specifically, the end 164 may be serrated substantially in the same manner as the downstream end 80 of the corona discharge element 68. The stub tube 162 and the corona discharge element 68 may be electrically interconnected by the strap 84. Any electrostatic charge not dissipated by a corona discharge at the roughened end 164 of the stub tube 162 should migrate to the corona discharge element 68 for dissipation.

In addition to or in place of using a corona discharge to dissipate an accumulated electrostatic charge, the charge may be reduced or dissipated by providing a conductive path between the charged parts of the vacuum cleaner 10 and an internally formed drain or dissipation device. In the vacuum cleaner 10, a suitable drain or dissipation device is provided by the armature laminations of the motor 28. An inexpensive method for electrically interconnecting the armature laminations of the motor 28 and the wand 16 utilizes the swivel connector 61 (FIGS. 1 and 8) that is fabricated of a nonconductive material such as plastic and is pivotally mounted on the floor cleaning unit 12 by a pair of pivot pins 88 and 89 positioned in pivot brackets (not shown) on the floor cleaning unit 12. The swivel connector 61 includes a tubular bore 90 through which flowing air and particulate matter collected by the floor cleaning unit 12 pass. An electrically conductive conductor 92 is molded into the inside wall of bore 90 and extends beyond an edge or flange 94 defined in the bore 90. To connect the wand 16 with the swivel connector 61, the wand 16 is inserted into the bore 90 until the downstream end of the wand 16 engages the flange 94. At this point, the pin 68 snaps into the aperture 60, locking the wand 16 in the swivel connector 61. This connection places the downstream end of the wand 16 into physical and electrical contact with the conductor 92.

A lower end 96 of the conductor 92 extends through the pivot pin 89. An electrical wire or lead 98 is electrically connected to the lower end 96 of the conductor 92 by a terminal 100. The lead 98 includes a serially interconnected 2.7 million ohm safety resistor 99. The lead 98 is also electrically connected to a conductive bracket 102 through a terminal 104. The bracket 102 is mounted on the floor cleaning unit 12 by a post 106 and supports or mounts a bearing 107 in which the armature 108 of the motor 28 rotates. An electrostatic charge accumulating on the wand 16 may, therefore, be dissipated or drained off, for example, by arcing from the armature laminations to other conductive portions of the motor 28 or, possibly, by ionizing the air surrounding the rotating armature 108. As a protective safety feature, the resistor 99 is placed in series between the wand 16 and the motor 28. The resistor 99 limits any electrical current resulting from the unlikely event of the failure of the insulation of the motor 28.

Figure 10:
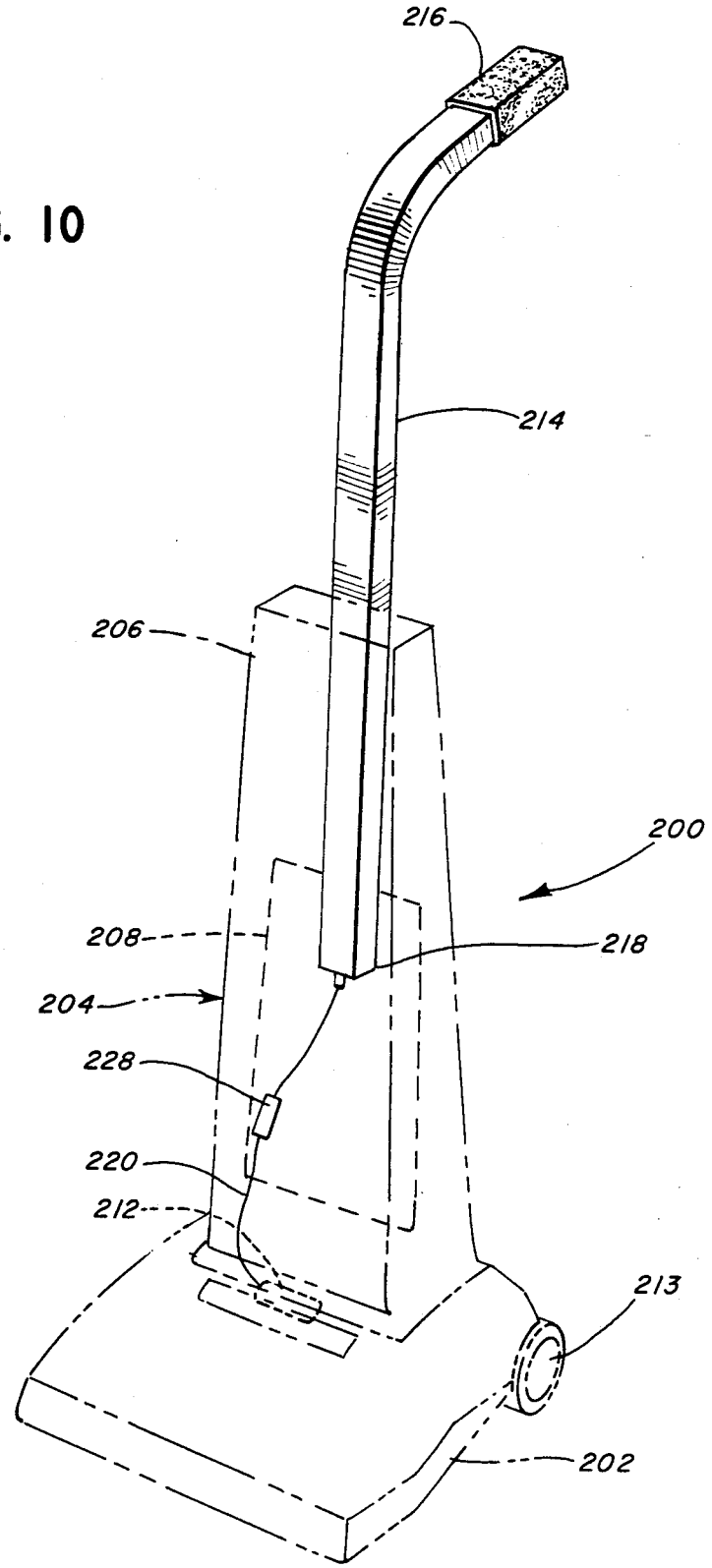
FIG. 10 depicts an upright vacuum cleaner including a ground wire connecting the handle and the motor of the vacuum cleaner in accordance with an alternative embodiment of the present invention.

Dissipating an electrostatic charge in an upright vacuum cleaner 200 (FIG. 10) may also be accomplished in accordance with the principles of the present invention. The vacuum cleaner 200 includes a base unit 202 and a handle-receptacle assembly 204 pivotally mounted to the base unit 202. The handle-receptacle assembly 204 includes a receptacle housing 206 that houses a debris receptacle 208, for example, a porous cloth or paper bag. A vacuum cleaner motor 212 for providing suction, for rotating an elongate carpet agitation or floor cleaning brush (not illustrated) mounted in a conventional manner for rotation in said base unit 202 and, in the case of self-propelled vacuum cleaners, for providing motive force for a plurality of drive wheels 213 is suitably mounted in the vacuum cleaner 200 either as part of the base unit 202 or as part of the assembly 204. The assembly 204 also includes an elongated hollow tube 214 with a handle 216 at one distal end. A second distal end 218 of the tube 214 is located in the receptacle housing 206.

Due to the proximity of the hollow tube 214 and the receptacle 208, an electrostatic charge resulting from the collection of dust and other particulate matter in the receptacle 208 may be transferred to the hollow tube 214. If an electrostatic charge accumulates on the tube 214, it could reach a sufficiently high potential to cause an unpleasant shock or harm to the user of the vacuum cleaner 200. Furthermore, such a charge could possibly damage any electronic controls located anywhere on the vacuum cleaner. For example, it has been found that absent the present invention, electrostatic discharges to the On/Off switch in the handle can disrupt electronic control devices mounted in the base unit 202.

This potentially harmful charge can be safely dissipated or drained off by electrically connecting the tube 214 to the rotating armature of the motor 212. In accordance with an important feature of the present invention, an electrical conductor or wire 220 is connected to the distal end 218 of the tube 214 and to the motor 212. The electrical connection to the field laminations of the motor 212 may be achieved in substantially the same manner as illustrated in FIG. 8 and as described hereinabove. Connecting to the field laminations or the armature or armature laminations appears to be equally effective. In the disclosed upright vacuum cleaner connecting to the field laminations was more convenient. The wire 220 includes a terminal clip 222 (FIG. 9) at one end for engagement with a wedge-shaped prong 224 formed in the end 218 of the tube 214. A second terminal 226 is formed at a second end of the wire 220 for engagement with a mount for the motor 212 in the same manner as the engagement of the wire 98 to the conductive bracket 102 (FIG. 8).

The electrical wire 220 includes a 2.7 million ohm resistor 228 connected electrically in series with the tube 214 and the motor 212 for limiting electrical current to prevent a shock to the user of the vacuum cleaner 200 in the unlikely event of a failure of the insulation of the motor 212.

Obviously, many modifications and variations of the present invention will become apparent from the above teachings. Thus, it is to be understood that, within the scope of the appended claims, the invention may be practiced otherwise than as specifically described hereinabove.

What is claimed and desired to be secured by Letters Patent of the United States is:

1. A vacuum cleaner comprising
an elongate conductive tubular member and
means for dissipating an electrostatic charge accumulated on said tubular member, said dissipating means comprising a motor disposed in said vacuum cleaner.

2. A vacuum cleaner as recited in claim 1 wherein said dissipating means further comprises an electrical conductor for electrically interconnecting said tubular member and said motor.

3. A vacuum cleaner as recited in claim 1 wherein said vacuum cleaner comprises a canister vacuum cleaner.

4. A vacuum cleaner as recited in claim 1 further comprising a floor cleaning unit and a remotely disposed canister unit and a flexible hose, said canister unit including suction means for enabling the flow of air through said vacuum cleaner, said tubular member comprising a rigid metal wand, said motor comprising a rotatable brush motor physically disposed in said floor cleaning unit, and said floor cleaning unit being mechanically and pneumatically interconnected by means of said rigid wand and said flexible hose.

5. A vacuum cleaner as recited in claim 4 wherein said dissipating means further comprises electrically conductive means for electrically interconnecting one end of said rigid wand and said motor.

6. A vacuum cleaner as recited in claim 5 wherein said motor includes a rotatable armature and wherein said conductive means comprises means for electrically interconnecting said one end and said armature.

7. A vacuum cleaner as recited in claim 5 wherein said dissipating means further comprises means for effecting a corona discharge into the air flowing through said vacuum cleaner.

8. A vacuum cleaner as recited in claim 7 further comprising a wand handle for mechanically and pneumatically interconnecting said flexible hose and said rigid wand and wherein said effecting means comprises a corona discharge element mounted in said wand handle.

9. A vacuum cleaner as recited in claim 8 wherein said corona discharge element includes a serrated edge, each serration of said serrated edge having a tip inclined inwardly into the air flowing through said vacuum cleaner.

10. A vacuum cleaner as recited in claim 9 wherein said wand handle further includes elongate conductive means for electrically interconnecting said rigid wand and said corona discharge element.

11. A vacuum cleaner as recited in claim 8 wherein said wand handle includes an electrically conductive stub tube, one end portion of said stub tube being electrically, mechanically and pneumatically interconnected with said rigid wand and the opposite end portion of said stub tube comprising said corona discharge element.

12. A vacuum cleaner as recited in claim 1 wherein said wand handle further includes an electrically conductive tubular stub tube, one end portion of said stub tube being electrically, mechanically and pneumatically interconnected with said rigid wand and the opposite end portion of said stub tube comprising a second corona discharge element.

13. A vacuum cleaner as recited in claim 1 wherein said vacuum cleaner comprises an upright vacuum cleaner and wherein said tubular member comprises a handle engageable by an operator of said vacuum cleaner.

14. A vacuum cleaner as recited in claim 13 wherein said dissipating means further comprises conductive means for electrically interconnecting one end of said tubular member and said motor.

15. A vacuum cleaner as recited in claim 14 wherein said motor includes a rotatable armature and wherein said conductive means comprises means for electrically interconnecting said one end and said armature.

16. A vacuum cleaner as recited in claim 1 further comprising electrical current limiting means serially disposed in said vacuum cleaner between said tubular member and said motor for limiting the amount of electrical current flowing therebetween in the event of a failure in the electrical insulation of said motor.

17. A canister vacuum cleaner comprising a floor cleaning unit having a rotatable brush and a brush motor for rotating said brush, a canister, physically separate from said floor cleaning unit, having disposed therein a suction means for providing a flow of air from said floor cleaning unit to said canister, and means for pneumatically interconnecting said canister and said floor cleaning unit, said pneumatically interconnecting means comprising a rigid wand and a wand handle and a flexible hose, said wand being adapted physically to engage and interconnect with said floor cleaning unit, said flexible hose being adapted physically to engage and interconnect with said canister, said wand handle being adapted physically to engage and to interconnect both said wand and said flexible hose, said brush motor comprising means for dissipating an electrostatic charge accumulated on said rigid wand, said rigid wand being electrically conductively connected to said brush motor.

18. A vacuum cleaner as recited in claim 17 further comprising means disposed in said wand handle for effecting a corona discharge into the air flowing through said wand handle thereby to dissipate an electrostatic charge accumulated on said rigid wand.

19. A vacuum cleaner as recited in claim 18 wherein said effecting means comprises a corona discharge ring having a serrated edge, said ring being electrically conductively connected to said rigid wand.

20. A vacuum cleaner as recited in claim 17 further comprising a current limiting resistor electrically connected in series between said brush motor and said rigid wand.

21. A canister vacuum cleaner comprising a floor cleaning unit having a rotatable brush and a brush motor for rotating said brush, a canister, physically separate from said floor cleaning unit, having disposed therein a suction means for providing a flow of air from said floor cleaning unit to said canister, means for pneumatically interconnecting said canister and said floor cleaning unit, said pneumatically interconnecting means comprising a rigid wand and a wand handle and a flexible hose, said wand being adapted physically to engage and interconnect with said floor cleaning unit, said flexible hose being adapted physically to engage and interconnect with said canister, said wand handle being adapted physically to engage and to interconnect both said wand and said flexible hose, and a current limiting resistor electrically connected in series between said rigid wand and said brush motor.

22. A method for dissipating an electrostatic charge on an elongate conductive tubular portion of a motorized vacuum cleaner comprising the steps of electrically conductively connecting said elongate conductive tubular portion to a motor of said vacuum cleaner, and energizing said motor and draining off said charge.

23. A method as recited in claim 22 further comprising the step of electrically connecting a current limiting resistor in series between said elongate tubular portion and said motor.

24. A method as recited in claim 22 further comprising the step of effecting a corona discharge into air flowing within said vacuum cleaner.

* * * * *